United States Patent [19]

Photopulos

[11] 4,150,678

[45] Apr. 24, 1979

[54] CUSHIONED RETAINER PADS FOR WIGS

[76] Inventor: Georgia M. Photopulos, 2727 W. Farragut Ave., Chicago, Ill. 60625

[21] Appl. No.: 880,421

[22] Filed: Feb. 23, 1978

[51] Int. Cl.[2] ..... A41G 3/00

[52] U.S. Cl. ..... 132/53

[58] Field of Search ..... 132/53, 54, 105, 5

[56] References Cited

U.S. PATENT DOCUMENTS

| | | | |
|---|---|---|---|
| 513,579 | 1/1894 | Kinzly | 132/53 |
| 3,037,261 | 6/1962 | Hess | 28/74 |
| 3,165,107 | 1/1965 | Martin et al. | 132/53 |
| 3,385,305 | 5/1968 | Buzzelli | 132/105 |
| 3,980,092 | 9/1976 | Garufi | 132/53 |

*Primary Examiner*—G. E. McNeill

*Attorney, Agent, or Firm*—Rummler & Snow

[57] ABSTRACT

A washable retainer which holds a wig on the head with friction-surfaced, flat, pillow-like pads having thickness to suspend the abrasive wig net from contact with the scalp and give body to the same, which wig will stay put in place and not allow shift when normally worn and which does not irritate the scalp of the wearer, because of its unique capability to conform to the natural contours of the head.

5 Claims, 9 Drawing Figures

FIG. 1
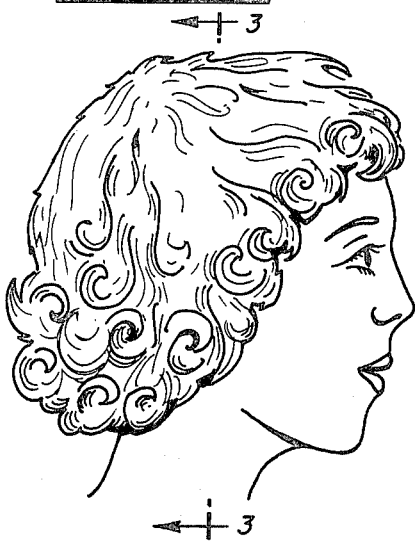
FIG. 2
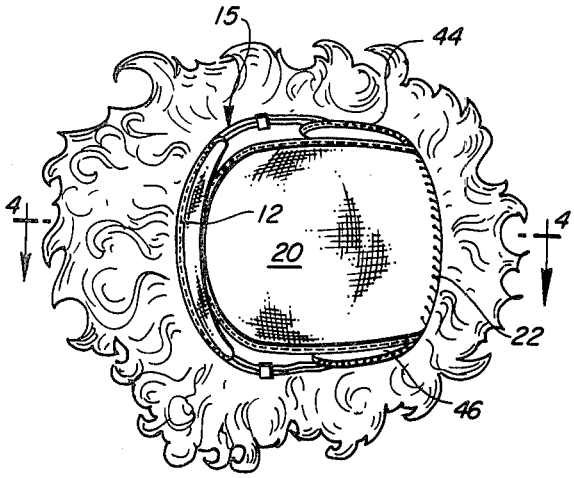
FIG. 3
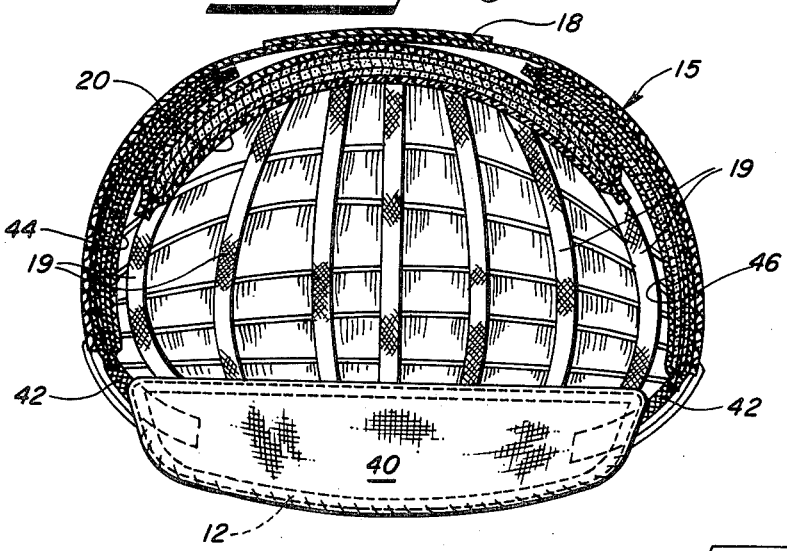
FIG. 4
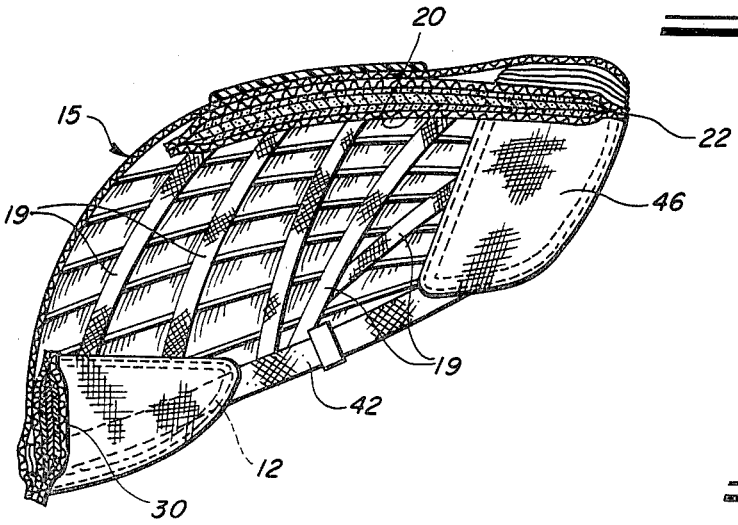
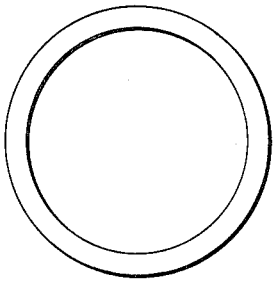
FIG. 9

CUSHIONED RETAINER PADS FOR WIGS

BACKGROUND OF THE INVENTION

In situations, for example, chemotherapy or radiation therapy treatments, where all or part of the hair is lost from the head of a person, normal wig construction poses problems of permanency of placement on the head and of physiological irritation of the scalp. Conventional wigs tend to lack body and lie flat on the scalp thereby detracting from the intended beautification of the person. Conventional wigs and hairpieces also tend to irritate the wearer because of the construction of the wig and inside lining.

There is thus an established and critical need for a convenient, minimal maintenance wig pad which will be retained in place on the head having its net or base held out of contact with a scalp that is devoid or partially devoid of hair, which wig simulates the body of one's own natural hair without scalp irritation or discomfort from tapes, adhesives or pins intended to affix the wig to the wearer's scalp.

SUMMARY OF THE INVENTION

The basis of this invention lies in an improvement in wigs securement and is composed of pads having friction-adhering sheathing and soft enclosures therein which may be attached to the wig by any suitable means usually along a portion of one edge to the headband of the conventional head net base in asymmetrical relation to the bisecting plane of the head on the crown and at approximately equally-spaced side and back-of-the-head locations, whereby the wig will be retained where positioned on the scalp, thereby eliminating irritation of wigs not having these pads or pad and thus providing greater comfort, less abrasion to the scalp, and can be adapted to any human hair or synthetic fiber cap design or model of men's, women's or children's wigs.

DESCRIPTION OF THE DRAWINGS

FIG. 1 shows a side elevational view of a wig having a net modified with flat, pillow-like pads having soft friction surfaces of this invention;

FIG. 2 shows a bottom elevational view of the same taken substantially along line 2—2 of FIG. 1;

FIG. 3 shows a greatly enlarged cross-sectional view of the same taken along line 3—3 of FIG. 1;

FIG. 4 shows a greatly enlarged cross-sectional view of the same taken along line 4—4 of FIG. 2;

FIG. 9 is a perspective view of a headband pad.

DESCRIPTION OF THE PREFERRED EMBODIMENT

Figure 5:
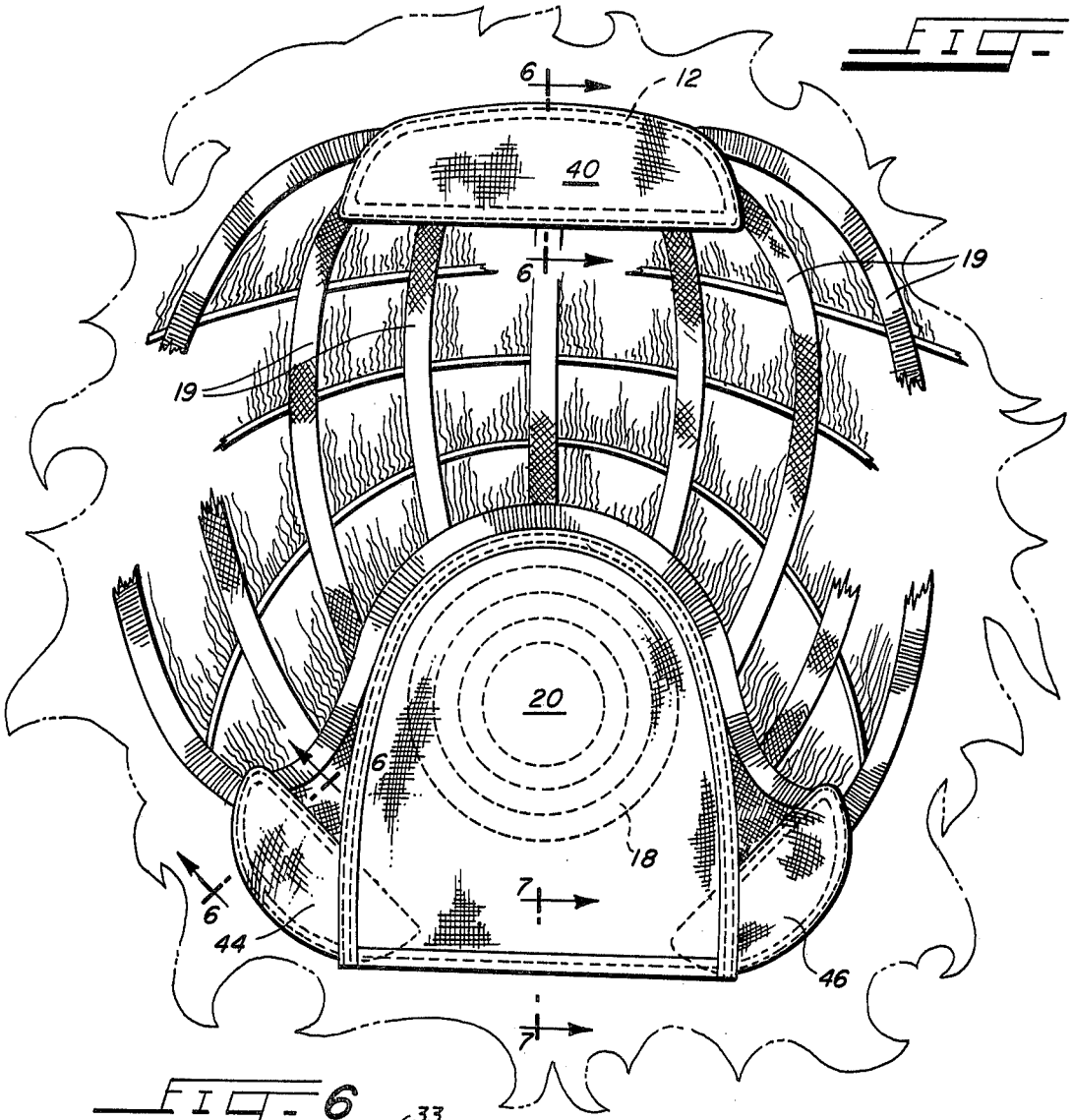
FIG. 5 is a layout elevational view of the wig of FIG. 1 showing the rear pad, side pads and crown pad of the same.

Reference too FIG. 1 shows a conventional wig 10 worn on a head comprising a skullcap 15 having a headband 12, as shown in FIG. 2, which is sewn to and around the lower edge of skullcap 15, as shown in FIG. 5, for encircling the head and worn as a cover of the scalp for a bald condition. A circular, flat crownpiece 18, as shown in FIGS. 4 and 5, mounts on and is sewn to the top of said skullcap 15. A plurality of fore-and-aft ribbons 19 are sewn to the under side of the crownpiece 18 in equal-spaced transverse relation from said crownpiece to said headband 12 and extend backwardly in a downwardly curved direction where they are sewn to the headband 12. A plurality of transverse ribbons 26 are sewn to the under side of the ribbons 19 and extend laterally in a downwardly curved direction where they are sewn to the headband 12.

Figure 6:
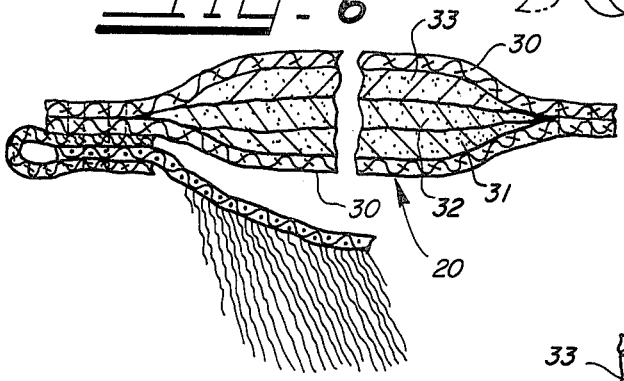
FIG. 6 shows a greatly enlarged, fragmentary, cross-sectional view of the rear pad taken along line 6—6 of FIG. 5.
Figure 7:
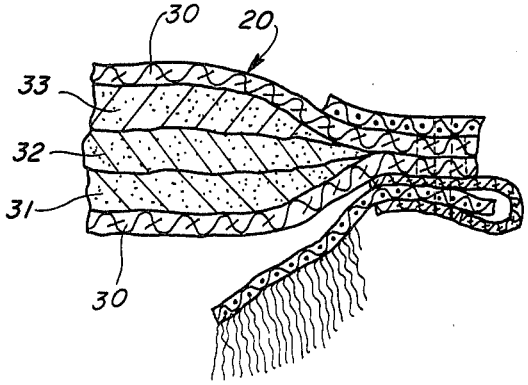
FIG. 7 shows an enlarged, fragmentary, cross-sectional view of the crown pad taken along line 7—7 of FIG. 5.
Figure 8:
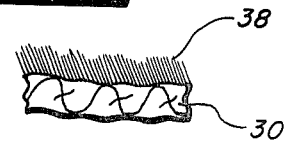
FIG. 8 shows an enlarged, fragmentary, cross-sectional view of the face area of the sheathing.

FIGS. 2, 4 and 5 show the main large pad 20 sewn along its forward edge to the forward section 22 of the headband 12. The pad 20 substantially covers the crownpiece and covers almost the forward half of the wig, as shown in FIG. 5, and prevents contact of the same with the scalp of the head and the area above the forehead. The pad 20 comprises a plurality of padding layers of soft material 31, 32 and 33 each laid flat on each other in vertical stacked relation, as shown in FIG. 6. These padding layers are similar to soft baby batting. It is to be understood that the pad layers may have less or more than three layers as described. A sheathing 30 which is sewn or otherwise secured together around its outer edge to enclose the layers 31, 32 and 33 is made of a material comprising preferably a product made from 50% polyester and 50% rayon. Preferably a plurality of 100% rayon flocking fibers 38 are glued or otherwise secured to the outer surface of the sheathing, as shown in FIG. 8. This gives the appearance of a suede-like surface and produces the anti-skid effect when placed on the scalp.

It is to be noted that the length of the main pad 20 is substantially the same as its width at the place of securement to the headband 12. The free end is arcuate shaped.

A rear pad 40 is sewn along a portion of its bottom edge to the rear section of the headband 12. The rear pad covers the inside of the back of skullcap 15 to seat against the nape of the neck. The rear pad 40 is constructed in the same way as the crown pad 20 excepting it is about three to four times as long as wide and the long edge which is secured to the band 12 is arcuate in shape, as shown in FIG. 5. The other end is straight.

Multiple side pads 44 and 46 are sewn along portions of their bottom edges to the band 12. These pads are constructed identically to the crown and rear pads. Pads 44 and 46 cover a portion of the inside of the sides of skullcap 15 and seat substantially against the upper ends of the temples. The free end is arcuate while the other side is straight. It is to be noted that a portion of the pads 44, 46 seats below a portion of the main pad 20 but it is not always required. Each pad may be separated along the inner periphery of the wig.

Most wigs are provided with elastic 42 on both sides of the wig whereby it may be stretched to place the same on the head and the elastic 42 will draw the wig to the head when relaxed; however, some wigs contain a very insignificant amount of stretch elastic.

Hair, real or synthetic, is secured to the members 19, 26 and 42 in the usual way.

One of the advantages of the present invention is the elimination of adhesive tapes, pins and other non-acceptable means for securing a wig to the scalp or hair of the human head.

The pads of this invention create a softness of contact to the scalp by a person wearing wigs to create greater comfort and allow for ready, natural escape of moisture from the head.

Although the drawings disclose a series of pads secured to the margins of the inner periphery of a wig, a single band constructed as described above could be substituted. See FIG. 9.

It will be understood that details of the construction shown may be altered or omitted without departing from the spirit of the invention as defined by the following claims.

I claim:

1. A pad means comprising layers of soft material positioned one on top of the other enclosed in a friction-adhering sheathing means to create a pad for a wig whereby when said pad is secured to the under side of a wig, it prevents shifting of the same on the head and irritation to the scalp by conforming to the natural contour of the head.

2. The device according to claim 1 wherein said sheathing means comprises a backing made of a synthetic material, and said material having a plurality of flocking fibers on the outer surface and said soft material is built up in layers.

3. The device according to claim 1 wherein a wig has a plurality of said pad means secured along portions of its edges to the inner peripheral edges of said wig.

4. The device according to claim 2 wherein said pad is secured to the lower side of a hairpiece to prevent it from accidental shifting, and said synthetic material is composed of polyester and rayon fibers.

5. The pad according to claim 1 wherein the same is variant in shape for affixing to the inner margins and crown surfaces of a wig, whereby the wig is elevated above the scalp and allows for escape of moisture.

* * * * *